US005540481A

United States Patent [19]

Roossien et al.

[11] Patent Number: 5,540,481

[45] **Date of Patent: *Jul. 30, 1996**

[54] CHAIR WITH ZERO FRONT RISE CONTROL

[75] Inventors: Charles P. Roossien, Wyoming; Dale M. Groendal, Jenison; James E. Massey, Wayland; Robert M. Scheper; Douglas A. Smith, both of Grand Rapids; David C. Pugh, Howard City, all of Mich.

[73] Assignee: Steelcase, Inc., Grand Rapids, Mich.

[ * ] Notice: The term of this patent shall not extend beyond the expiration date of Pat. No. 5,318,346.

[21] Appl. No.: 236,335

[22] Filed: May 2, 1994

Related U.S. Application Data

[63] Continuation of Ser. No. 55,927, Apr. 30, 1993, Pat. No. 5,318,346, which is a continuation of Ser. No. 707,465, May 30, 1991.

[51] Int. Cl.[6] ..... A47C 3/00

[52] U.S. Cl. ..... 297/300.4; 297/463.1; 297/DIG. 2

[58] Field of Search ..... 297/300, 301, 297/302, 285, 354.1, 316, 326, 340, 452.15, DIG. 2, 300.1, 300.2, 301.1, 302.1, 300.4, 463.1

[56] References Cited

U.S. PATENT DOCUMENTS

| | | | |
|---|---|---|---|
| Re. 29,522 | 1/1978 | Barecki | 297/445 |
| D. 285,629 | 9/1986 | Franck et al. | D6/366 |
| 357,388 | 2/1887 | Hunzinger . | |
| 1,491,918 | 4/1924 | Nolan . | |
| 1,692,252 | 11/1928 | Eichman . | |
| 1,912,282 | 5/1933 | Krebs . | |
| 2,324,318 | 7/1943 | Niedringhaus | 155/119 |
| 2,365,200 | 12/1944 | Lorenz | 155/55 |
| 2,480,552 | 8/1949 | Colvez | 155/99 |
| 2,706,518 | 4/1955 | Fleischer | 155/194 |
| 2,745,468 | 5/1956 | Kramer | 155/53 |
| 2,853,125 | 9/1958 | Starke | 155/183 |
| 3,006,685 | 10/1961 | Ewert | 297/30 |
| 3,140,118 | 7/1964 | Dorn | 297/285 |
| 3,146,028 | 8/1964 | Grosfillex | 297/440 |
| 3,167,352 | 1/1965 | Johnson | 297/445 |
| 3,174,797 | 3/1965 | Neufeld | 297/218 |
| 3,298,743 | 1/1967 | Albinson et al. | 297/445 |
| 3,357,740 | 12/1967 | Vaughn et al. | 297/416 |
| 3,632,150 | 1/1972 | Milakovich | 287/20.926 |
| 3,650,576 | 2/1972 | Morrison et al. | 297/440 |
| 3,669,495 | 6/1972 | Von Rudgisch | 297/445 |
| 3,669,499 | 6/1972 | Semplonius et al. | 297/455 |
| 3,743,352 | 7/1973 | Kallander | 297/285 |
| 3,752,533 | 8/1973 | Gilbert | 297/445 |
| 3,778,102 | 12/1973 | Snyder et al. | 297/170 |
| 3,797,887 | 3/1974 | Barecki et al. | 297/454 |
| 3,841,704 | 10/1974 | Platner et al. | 297/458 |
| 3,873,155 | 3/1975 | Barecki | 297/445 |
| 3,874,727 | 4/1975 | Mehbert et al. | 297/320 |
| 3,874,729 | 4/1975 | Blodee | 297/445 |
| 3,883,257 | 5/1975 | Delafield | 403/172 |
| 3,907,363 | 9/1975 | Baker et al. | 297/445 |

(List continued on next page.)

FOREIGN PATENT DOCUMENTS

| | | |
|---|---|---|
| 110887 | 7/1940 | Australia . |
| 063860 | 11/1982 | European Pat. Off. . |

*Primary Examiner*—Milton Nelson, Jr.

*Attorney, Agent, or Firm*—Price, Heneveld, Cooper, DeWitt & Litton

[57] ABSTRACT

A structural support shell for a tilt-back chair has a back portion, a seat portion, and a flexible compression zone extending between the back and seat portions in an integrally molded, one-piece unit. The chair has a base with a recline control pivoting recline control lever. The seat portion of the shell is fixed to the base and the back portion of the shell is fixed to the recline control lever. The flexible compression zone provides a simplified construction for an ergonomic chair design having an effective axis of rotation between the back portion and seat portion which is located above the seat portion, forward of the back portion, and generally adjacent to the hip joints of a seated user.

35 Claims, 5 Drawing Sheets

U.S. PATENT DOCUMENTS

| | | | |
|---|---|---|---|
| 4,040,665 | 8/1977 | Wallace et al. | 297/417 |
| 4,057,291 | 11/1977 | Dubinsky | 297/441 |
| 4,065,182 | 12/1977 | Braniff et al. | 297/452 |
| 4,099,774 | 7/1978 | Sandham | 297/298 |
| 4,131,315 | 12/1978 | Vogtherr | 297/286 |
| 4,152,023 | 5/1979 | Buhk | 297/452 |
| 4,265,483 | 5/1981 | Raftery et al. | 297/440 |
| 4,270,797 | 6/1981 | Bräuning | 297/300 |
| 4,304,436 | 12/1981 | Rowland | 297/239 |
| 4,359,245 | 11/1982 | Franke | 297/284 |
| 4,390,206 | 6/1983 | Faiks et al. | 297/300 |
| 4,390,210 | 6/1983 | Wisniewski et al. | 297/452 |
| 4,408,802 | 10/1983 | Adomeit | 297/452 |
| 4,438,898 | 3/1984 | Knoblauch et al. | 248/561 |
| 4,451,085 | 5/1984 | Franck et al. | 297/285 |
| 4,479,679 | 10/1984 | Fries et al. | 297/300 |
| 4,494,795 | 1/1985 | Roossien et al. | 297/355 |
| 4,498,702 | 2/1985 | Raftery | 297/312 |
| 4,527,832 | 7/1985 | McMains et al. | 297/355 |
| 4,529,247 | 7/1985 | Stumpf et al. | 297/301 |
| 4,533,177 | 8/1985 | Latone | 297/301 |
| 4,557,521 | 12/1985 | Lange | 297/285 |
| 4,588,227 | 5/1986 | Austin | 297/440 |
| 4,603,904 | 8/1986 | Tolleson et al. | 297/296 |
| 4,685,730 | 8/1987 | Linguanotto | 297/316 |
| 4,717,195 | 1/1988 | Okuyama et al. | 296/72 |
| 4,718,153 | 1/1988 | Armitage et al. | 29/91.1 |
| 4,744,603 | 5/1988 | Knoblock | 297/457 |
| 4,754,529 | 7/1988 | Paradis | 24/16 |
| 4,768,905 | 9/1988 | Reynard | 410/78 |
| 4,776,633 | 10/1988 | Knoblock et al. | 297/300 |
| 4,789,201 | 12/1988 | Selbert | 292/218 |
| 4,792,189 | 12/1988 | Shovar | 297/452 |
| 4,830,435 | 5/1989 | Nemschoff et al. | 297/440 |
| 4,840,426 | 6/1989 | Vogtherr et al. | 297/300 |
| 4,889,385 | 12/1989 | Chadwick et al. | 297/302 |
| 4,900,090 | 9/1990 | Davis | 297/440 |
| 4,979,778 | 12/1990 | Shields | 297/301 |
| 5,015,038 | 5/1991 | Mrotz, III | 297/457 |
| 5,067,772 | 11/1991 | Koa | 297/452 |
| 5,102,196 | 4/1992 | Kaneda et al. | 297/457 |
| 5,110,186 | 5/1992 | Clark et al. | 297/444 |
| 5,114,211 | 5/1992 | Desanta | 297/301 |
| 5,238,294 | 8/1993 | Ishi et al. | 297/301 |
| 5,314,240 | 5/1994 | Ishi et al. | 297/452.15 |

CHAIR WITH ZERO FRONT RISE CONTROL

CROSS REFERENCE TO RELATED APPLICATIONS

This is a continuation of U.S. application Ser. No. 08/08/055,927, now U.S. Pat. No. 5,318,346 entitled CHAIR WITH ZERO FRONT RISE CONTROL and filed on Apr. 30, 1993, by Roossien et al., now U.S. Pat. No. 5,318,346, issued Jun. 7, 1994.

BACKGROUND OF THE INVENTION

The present invention relates to seating and more particularly to a chair for general office use.

Many office chairs have a seat portion and a back portion which tilts or reclines relative to a fixed base or support pedestal. This reclining action is accomplished by widely varying approaches, both structurally and philosophically. Relatively simple approaches, which include a chair control and a seat and back joined as a rigid unit, do not consider the natural motions and movement of the human body. The user is required to adapt to the chair. However, one common goal in contemporary design of office seating is the comfort of the user from the perspective of enhancing or at least not degrading the performance of the user in accomplishing the tasks of the office. With such attention directed to the performance of the user, interest has turned to the study of ergonomics in office seating. With the realization and development of ergonomics, a seating designer will endeavor to adapt the chair to follow the natural movement of the user. This can and has lead to sophisticated and complicated constructions which are correspondingly difficult and expensive to manufacture.

Ergonomics has led designers of office seating to focus on the natural and beneficial movements and positioning of a chair user and specifically the user's hips. The hip joints of an average user, seated upright with good posture in a chair, normally lie along an imaginary, generally horizontally oriented axis approximately 3 to 4 inches above the seating surface of the chair and approximately 3 to 5 inches forward of the plane of the chair back. The location of this hip joint axis in side elevational view with respect to a chair is generally referred to as the "H" point. Although the "H" point varies from one individual to another, depending upon the specific physical characteristics of the user, a model or preferred "H" point can be derived empirically, based upon studies of a wide range of different users. The "H" point is significant in ergonomic chair design because a user tends to rotate or roll the pelvis about the "H" point when moving from an upright or task position to a reclined or rest position. Therefore, it is desirable to approximate the "H" point axis in the construction of a chair recline control.

One chair structure responsive to ergonomic chair design and which attempts to approximate the "H" point axis incorporates a synchrotilt-type mechanism. In the synchrotilt mechanism, the seat portion of a chair moves in synchronization with the tilting of the back portion of the chair.

One such chair is disclosed by Linguanotto in U.S. Pat. No. 4,685,730, entitled SEAT, ESPECIALLY WORK SEAT, WITH SEVERAL POSITIONS, issued on Aug. 11, 1987. Linguanotto uses a three-piece seating cushion wherein a front seating portion is pivotally connected to a chair base and to a rear seating portion. The rear seating portion is hingedly connected to a back portion and is supported by a tilt bracket. The tilt bracket is a part of a chair control and is pivotally connected relative to the base. The back portion is also pivotally connected to the bracket.

Another synchrotilt chair is disclosed by Shields in U.S. Pat. No. 4,979,778, entitled SYNCHROTILT CHAIR, issued on Dec. 25, 1990. The Shields chair has separate seat and back portions with the seat portion connected to a chair base, at a front area of the seat portion, by a double pivot link. The seat portion is also pivotally connected to the back. The back portion is connected to a tilt: control. When the back reclines, the rear of the seat portion moves rearwardly and downwardly, and the front of the seat portion moves rearwardly and downwardly lowering overall seat height.

Knoblock et al. disclose another synchrotilt chair in U.S. Pat. No. 4,776,633, entitled INTEGRATED CHAIR AND CONTROL, issued on Oct. 11, 1988. Knoblock et al. disclose the use of a structural shell having a seat portion and a back portion for use with a tilt mechanism. The back and seat portions are interconnected for mutual rotation about a common axis located above the seat portion and generally adjacent the hip joints of the seated user. A chair control supports the back and seat portions so that tilting of the back shifts the seat portion and the location of the common axis.

Yet another synchrotilt chair is disclosed by Franck et al. in U.S. Pat. 4,451,085, entitled CHAIR, issued on May 2, 1984. This chair uses a seat portion and a back portion which are interconnected by a flexible intermediate portion to accommodate changes in angle between the back and seat portions, when the back reclines. The seat portion is pivotally connected to a chair base, near a front edge of the seat portion. The back portion is connected to the chair base by a link which is pivotally connected at the back portion and pivotally connected at the base.

SUMMARY OF THE INVENTION

A chair according to the present invention provides a unique approach to the ergonomic design of reclining chairs by the use of a support shell having an integrally molded seat portion, back portion and a flexible compression zone, between the seat and back portions. ! n one aspect of the invention, the seat portion is fixed to a chair base and the back portion is fixed to a chair tilt control mechanism. The flexible compression zone flexes and compresses as the back portion reclines relative to the seat portion and chair base.

In another aspect of the invention, the chair is provided with side arms. The side arms are fixed to the back portion of the chair at one end and pivotally connected to the chair base, beneath the seat portion of the chair, at an opposing end. In another aspect of the invention, outer back and outer seat shells are provided with integrally molded fasteners and the support shell is provided with corresponding apertures for receiving the fasteners so that the outer shells may be fastened to the support shell.

The chair of the present invention provides a simple and unique solution to the ergonomic chair design problem which heretofore has been answered with a myriad of sophisticated and complicated constructions. The chair may be provided with rigid side arms which pivot with the recline of the chair back and do not require any special, flexible materials. Further, the assembly of the chair is simplified by the use of integrally molded fasteners for attaching outer back and outer seat shells to the structural support shell, minimizing the number of components required for assembly and enhancing the ability to disassemble and reassemble the chair for recovering or other maintenance.

These and other objects, advantages and features of the present invention will become apparent upon review of the following specification in conjunction with the drawings.

DESCRIPTION OF THE PREFERRED EMBODIMENTS

Figure 1:
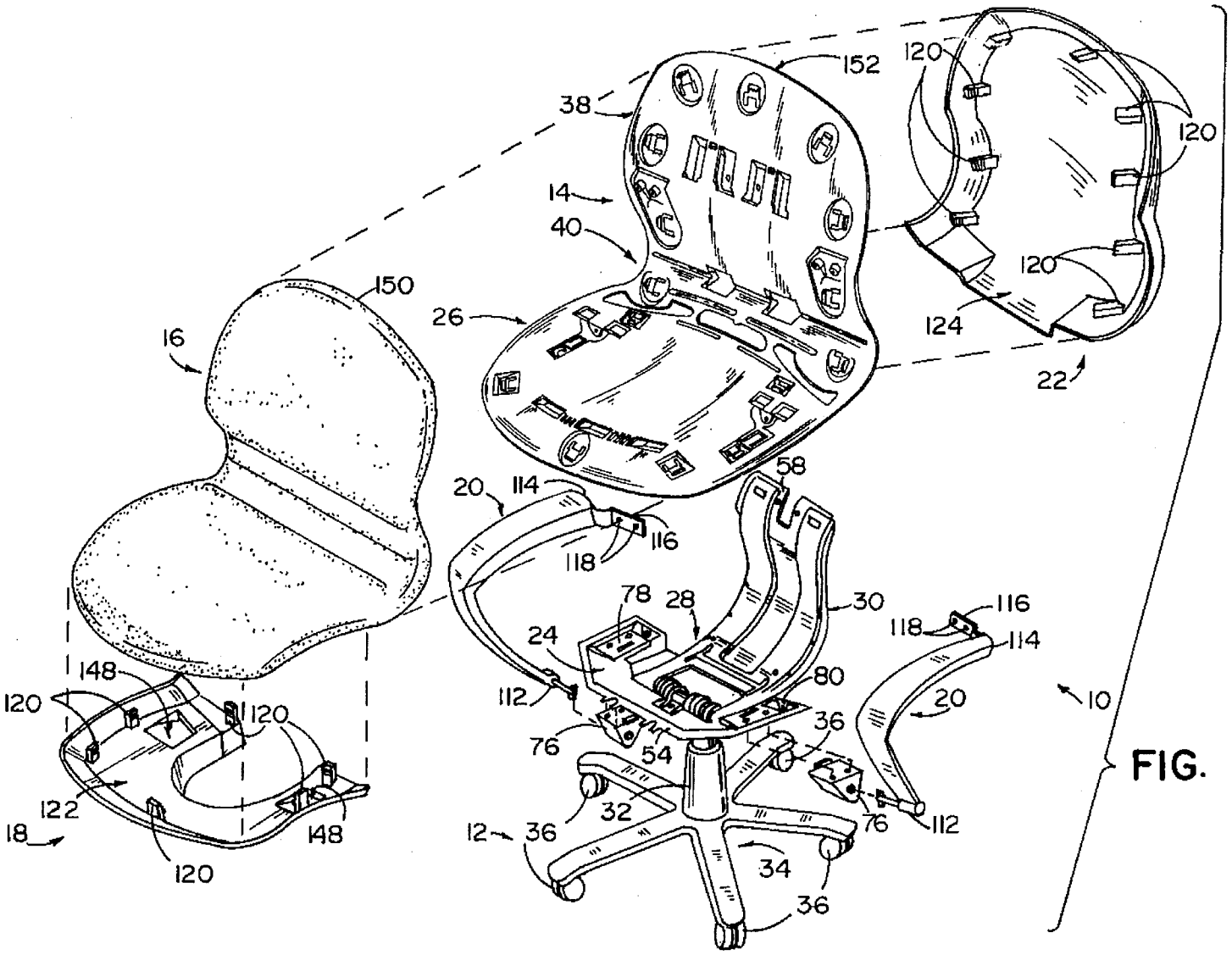
FIG. 1 is an exploded perspective view of a chair according to the present invention.

A preferred embodiment of a chair of the present invention is shown in FIGS. 1–5 and generally designated by the numeral 10. Chair 10 of the present invention includes a chair base 12, structural shell 14, cushion assembly 16 decorative outer seat shell 18, side arms 20, and decorative outer back shell 22 (FIG. 1).

Chair base 12 includes a base pan 24 which provides a fixed structure to which a seat portion 26 of structural shell 14 and side arms 20 are fastened. Pan 24 is preferably a stamped mild steel member and conventionally welded to a chair tilt control 28. Control 28 includes a back support member, bracket control lever, or control arm 30.

Figure 3:
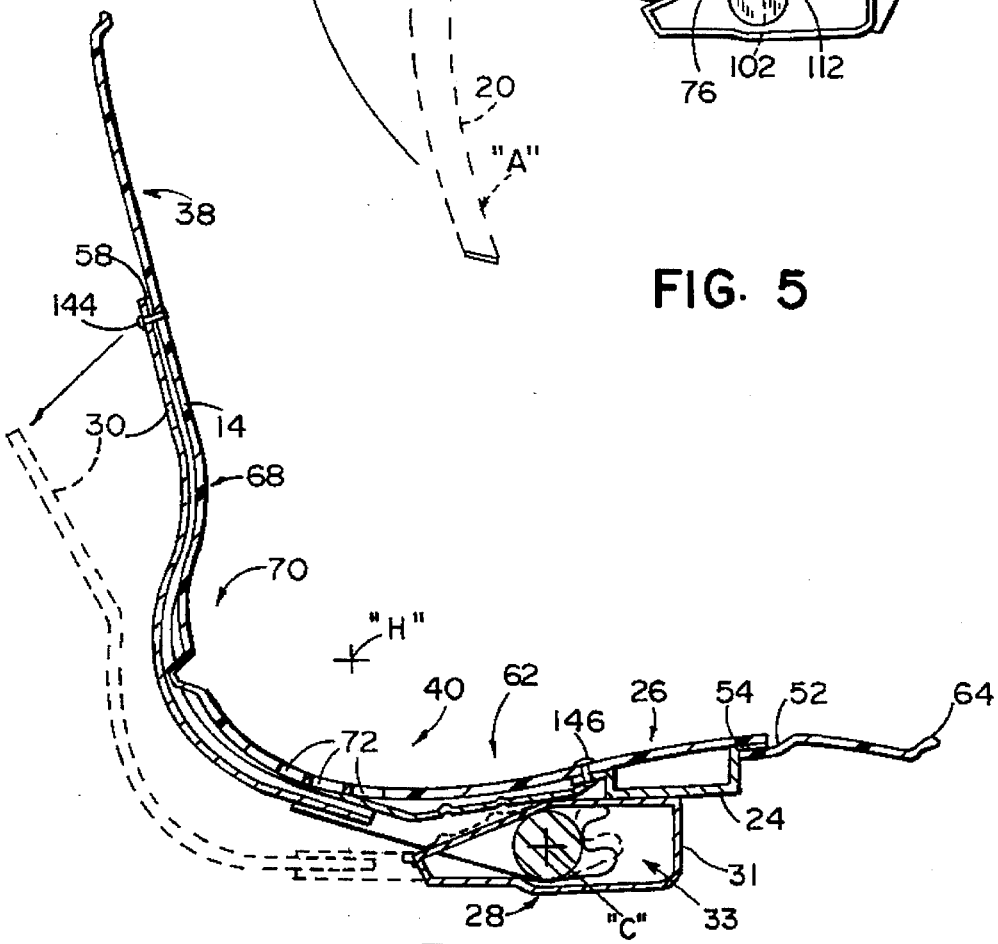
FIG. 3 is a fragmentary center line sectional view of the chair of FIG. 1.

Control 28 preferably has a housing 31 which is joined to pan 24 and includes a conventional, adjustable torsion spring subassembly 33. Subassembly 33 biases bracket 30 toward an upright or task position, as opposed to a reclined or rest position. Bracket 30 is fixed to the spring subassembly and pivots about an axis "C", as shown in FIG. 3.

Chair base 12 further includes a pedestal or column 32 upon which chair tilt control 28 is conventionally mounted (FIG. 1). Pedestal 32 may include any of a variety of known height adjustment mechanisms. Pedestal 32 preferably extends upward from a five arm base 34. Base 34 is preferably provided with casters 36, but may alternatively be provided with chair glides (not shown).

Figure 2:
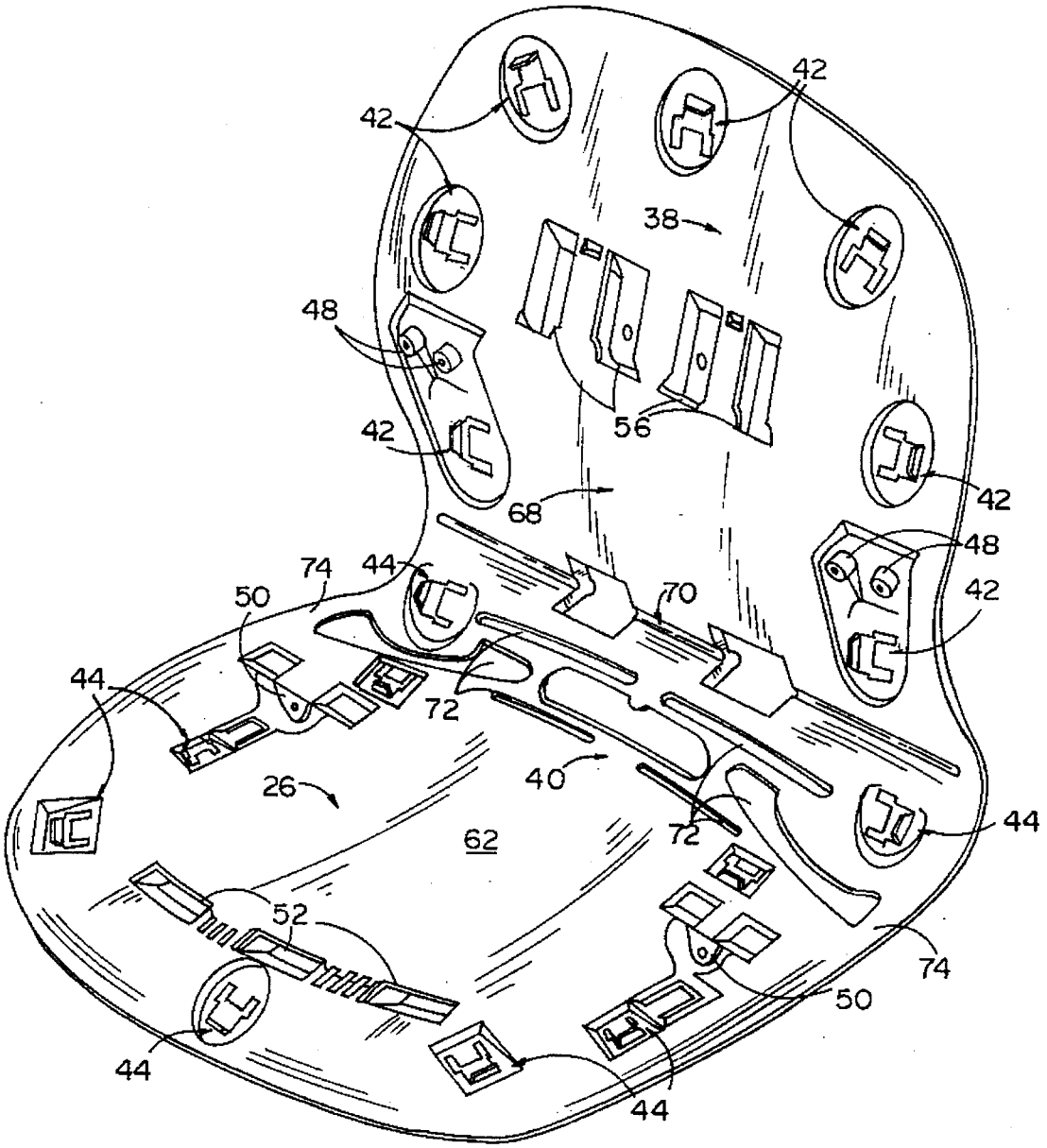
FIG. 2 is a perspective view of the structural support shell of the chair of FIG. 1.

Structural shell 14 is a unitary or integral shell having seat portion 26, a back portion 38, and a flexible compression zone 40, extending between the seat and back portions 26, 38, respectively (FIGS. 1 and 2). Structural shell 14 serves to support cushion assembly 16 in a manner that allows a user to move naturally and freely in chair 10 during the performance of a variety of tasks and activities. Structural shell 14 has a generally L-shaped side elevational configuration (FIGS. 1–3), and is constructed of a resilient, semi-rigid, synthetic resin material, which normally retains its molded shape, but permits some flexing. Shell 14 is preferably molded from a polypropylene plastic, but may also be molded from other materials having the above, desirable characteristics. Back portion 38 of structural shell 14 may be selectively stiffened in accordance with the commonly assigned U.S. Pat. No. 4,744,603, entitled CHAIR SHELL WITH SELECTIVE BACK STIFFENING, issued on May 17, 1988 to Knoblock. Structural shell 14 includes two sets of fastener apertures 42, 44, two sets of apertures 48, 50 for receiving threaded fasteners, a series of tabs 52 for engaging the front edge 54 of pan 24 and a series of projecting tabs 56 for engaging the top edge 58 of control arm or bracket 30. Shell 14 is fixed at seat portion 26 to pan 24 by fasteners 146. Back portion 38 is fixed to bracket 30 by fasteners 144 (FIG. 3). The shell is, in effect, suspended hammock-style by the two-point attachment. The front is fixed, however, so that there is zero rise of the front when the back is reclined or tilted.

Seat portion 26 of structural shell 14 has a generally concave surface forming a shallow bowl 62 to receive and support the buttocks of a user. Seat portion 26 becomes more planar and rolls off gently toward the forward edge 64 of structural shell 14 to support the rear of the thighs of a user. Shell 14 provides a gentle release of support and avoiding a harsh transition line where the thighs leave the support of the chair 10 at front edge 64.

Back portion 38 also has a complexly curved surface. The upper approximately one-half of back portion 38 has a shallow, transversely concave curvature, providing subtle, wraparound support to the thoracic and shoulder regions of a user. Below the upper concave portion, back portion 38 transitions through a convex area 68 to a concave area 70 near flexible compression zone 40. Each of convex and concave areas 68, 70, respectively, are generally linear transversely with the curvature of convex area 68 formed about an imaginary axis behind back portion 38 and the curvature of concave area 70 formed about an imaginary axis approximating the "H" point of a user (FIG. 3).

Flexible compression zone 40 is a generally concave area transitioning from area 70 of back portion 38 to bowl 62 of seat portion 26 (FIGS. 2 and 3). ! n the illustrated example, flexible compression zone 40 comprises a plurality of elongated slots 72 through structural shell 14 in a predetermined pattern. Slots 72 selectively relieve structural shell 14 at the flexible compression zone 40 and permit the shell to flex and compress, simulating rotation approximately about an imaginary horizontal axis at the "H" point.

A pair of hinges 74 rotatably interconnect seat portion 26 and back portion 38 (FIG. 2). In the illustrated example, hinges 74 are living hinges, defined by strap-like portions of structural shell 14, integrally molded with the shell, between seat portion 26 and back portion 38. As shown in the illustrated example, hinges 74 are preferably positioned at the outermost periphery of structural shell 14.

Figure 8:
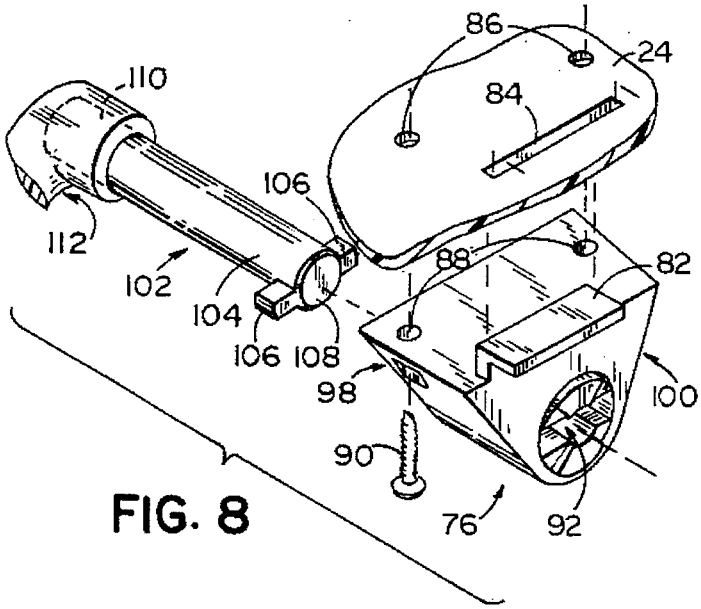
FIG. 8 is an exploded fragmentary perspective view of a pivot arm connector used with the chair of FIG. 1.

A pair of bearing blocks 76 are screw mounted to pan 24 at opposing sides 78, 80 (FIG. 1). Each bearing block 76 has a mounting tab 82 which engages a corresponding mounting slot 84, provided in pan 24 (FIG. 8). A pair of screw holes 86 are also provided in base pan 24 and align with screw holes 88, through bearing block 76. Screw holes 88 are sized larger than self-tapping screws 90 so that the screws easily slip into and extend through screw holes 88. Screw holes 86 are sized smaller than screws 90 for engagement with the threads of the screws. Each bearing block 76 is preferably injection molded of an acetal resin thermoplastic or other suitable engineering plastic.

Figure 9:
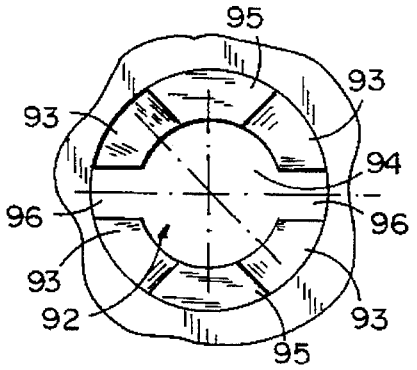
FIG. 9 is an elevational detail view of the connector of FIG. 8.

A pin aperture 92 having a cylindrical center portion 94 and keyways 96 extends through bearing block 76 from a front surface 98 through a back surface 100 (FIGS. 8 and 9). Pin aperture 92 is configured to receive a pivot pin 102. Pivot pin 102 includes a cylindrical shaft 104. A pair of ears 106 project perpendicularly from shaft 104 at a terminal end 108. Ears 106 are preferably oriented approximately 180° apart from each other. A tang end 110 of pivot pin 102 is connected at a lower end 112 of a side arm 20. Each side arm 20 is preferably molded around tang 110, which is also preferably knurled to enhance mechanical connection between tang 110 and side arm 20.

Pairs of arcuately shaped camming surfaces 93 are concentrically formed around pin aperture 92 on back surface 100 of bearing block 76 (FIG. 9). Ears 106 engage camming surfaces 93 when pivot pin 102 is inserted through pin aperture 92, and arm 20 is assembled to chair 10, as discussed below. A flat surface 95 projects from back surface 100, between each pair of camming surfaces 93, for engagement with ears 106 after arm 20 has been assembled.

Figure 5:
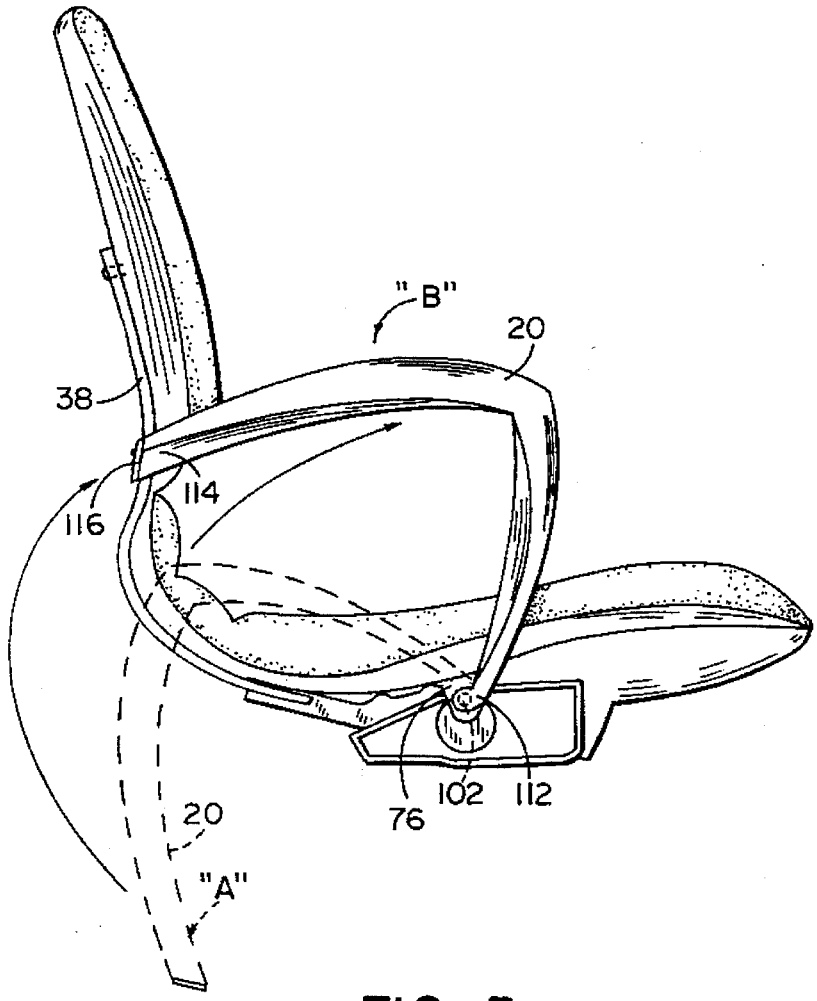
FIG. 5, is a fragmentary side elevational view of the chair of FIG. 1 showing the rotation of a side arm between removal and assembled positions.

Each side arm 20 is preferably injection molded of a polypropylene plastic or other suitable structural plastic material and is a mirror image replica of the opposing side arm 20 (FIGS. 1 and 5). Each side arm 20 has an upper end 114. An angle bracket 116 is provided at upper end 114 for fastening arm 20 to back portion 38. Angle bracket 116 has a pair of screw holes 118 through a first leg of the bracket for screw attachment of upper end 114 to back portion Angle bracket 116 also has a second leg (not shown) which is integrally molded into upper end 114 of side arm 20.

Figure 6:
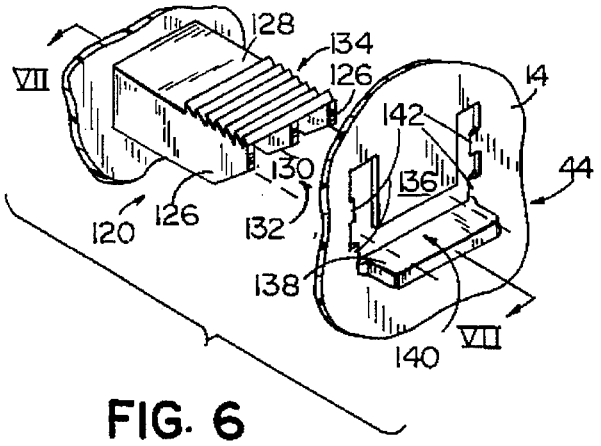
FIG. 6 is an exploded fragmentary perspective view of a fastener used with the chair of FIG. 1.
Figure 7:
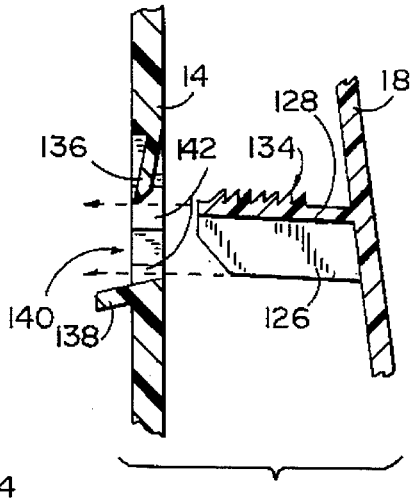
FIG. 7 is a sectional view along VII—VII of FIG. 6.

A plurality of fastener studs 120 are integrally molded with and project from the inner surfaces 122, 124 of outer seat shell 18 and outer back shell 22, respectively (FIG. 1 ). Outer shells 18, 22 and fastener stud 120 are preferably injection molded of a polypropylene plastic or other suitable structural plastic material. Fastener stud 120 is a generally U-shaped channel member having opposing sidewalls 126 and an interconnecting bight portion 128 (FIGS. 6 and 7). A center stiffening rib 130, which is generally parallel to opposing sidewalls 126 and depends from bight portion 128, may be used to enhance the structural stability of the fastener. As detailed in FIGS. 6 and 7, fastener 120 extends from surface 122 of decorative outer seat shell 18 to a terminal end 132. However, a plurality of fastener studs 120 project from both outer seat shell 18 and outer back shell 22. Fastener 120 has a series of biased teeth 134 formed on an outer surface of bight portion 128, near terminal end 132. Teeth 134 slope away from terminal end 132 so that fastener stud 120 may easily be inserted in an aperture 42 for attaching outer back shell 22 to structural shell 14 and aperture 44 for attaching outer seat shell 18 to structural shell 14 and to resist withdrawal of fastener stud 120.

Each aperture 42, 44 is generally rectangular, corresponding to fastener stud 120. As detailed in FIGS. 6 and 7 with reference to aperture 44, a flexible tab 136 extends into aperture 44 for engagement with teeth 134 when fastener stud 120 is inserted through the aperture. Opposing guide tabs 142 are provided along opposing sides of aperture 44, 42. A thickened edge, forming a wearplate 138, is formed along one side of the aperture 44, opposite tab 136 Wearplate 138 minimizes the potential wear and deformation of aperture 44 from contact with fastener stud 120. A gap 140 is defined between tab 136 and wearplate 138. Gap 140 is slightly less than the depth across sidewalls 126 so that tab 136 is held in a deflected or over center position to resist withdrawal of fastener stud 120 after fastener stud 120 is inserted into aperture 44. Wearplate 138 is particularly important when fastener stud 120 is withdrawn from aperture 44, since tab 136 will toggle over its center position and force fastener stud 120 against wearplate 138 when fastener stud 120 is withdrawn.

Cushion assembly 16 is a molded, upholstered chair cushion comprising an upholstery fabric attached to a sculpted chair cushion and having a perimeter fabric flap 150. Cushion assembly 16 may be formed in accordance with the commonly assigned U.S. Pat. No. 4,718,153, entitled CUSHION MANUFACTURING PROCESS, issued on Jan. 12, 1988 to Armitage et al. Cushion assembly 16 is simply assembled to structural shell 14 by positioning cushion assembly 16 on structural shell 14, wrapping fabric flap 150 around the peripheral edge 152 of structural shell 14 and preferably gluing flap 150 to the back surface of structural shell 14. Flap 150 may be glued to structural shell 14 with any of a variety of upholstery adhesives which are commonly known and used.

Structural shell 14 is assembled to chair base 12 by engaging tabs 52 with front edge 54 of pan 24 and engaging tabs 56 with top edge 58 of recline control lever 30 or bracket (FIG. 1). Back portion 38 is fastened and fixed to control lever or bracket 30 near top edge 58 by conventional methods and most preferably by self-tapping screws 144 through tabs 56 and lever 30 (FIG. 3). Seat portion 26 is fastened to chair base 12 at opposing sides 78, 80 of base pan 24 by conventional methods and most preferably by self-tapping screws 146.

After assembling bearing blocks 76 to base pan 24 at opposing sides 78, 80 by inserting mounting tabs 82 through mounting slot 84 and securing block 76 to pan 2 4 with self-tapping screws 90, as described above, outer seat shell 18 is simply assembled to seat portion 26 of structural shell 14 by aligning and inserting corresponding fastener studs 120 with apertures 44. Two cutouts 148 are provided in outer seat shell 18 so that bearing blocks 76 extend through and below outer seat shell 18.

Side arms 20 are assembled to chair 10 by positioning side arm 20 in assembly or removal position "A", as shown in FIG. 5, aligning pivot pin 102 with pin aperture 92, inserting the pivot pin 102 through the aperture 92 and rotating the side arm 20 generally forward to assembled position "B". With side arm 20 in the assembled position, upper end I 14 of side arm 20 may be screw-fastened to back portion 38 by inserting a pair of self-tapping screws through angle bracket 116 and screwing the screws into apertures 48.

As with outer seat shell 18, outer back shell 22 is simply assembled to structural shell 14 by aligning fastening studs 120 with apertures 42 and inserting the studs 120 through the apertures 42.

Chair 10 is easily disassembled by reversing the above described assembly process, as required for reupholstery or maintenance of chair 10. Further, decorative outer seat and back shells 18, 22, respectively, may be used with an upholstery covering as is commonly known or may be used without a covering without affecting the scope of the invention.

Figure 4:
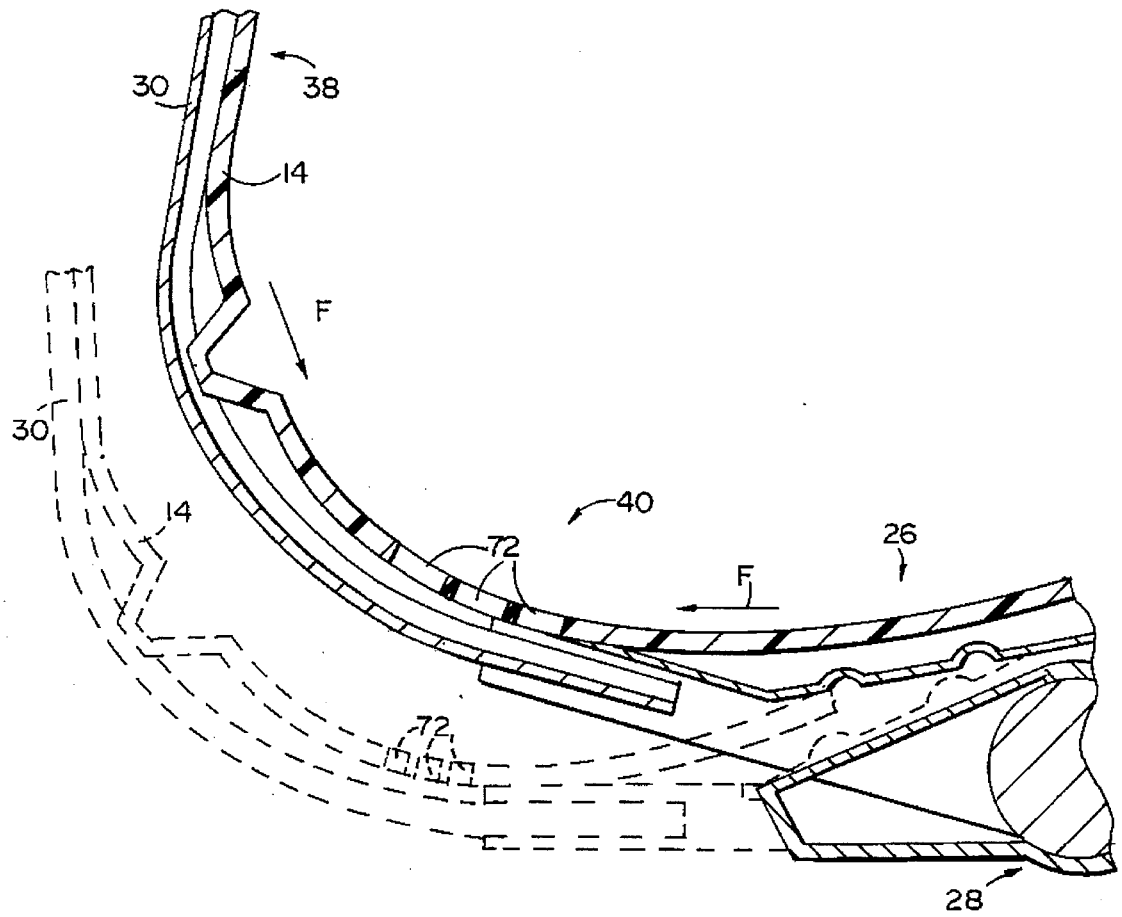
FIG. 4 is a detail of FIG. 3 showing the flexible compression zone in upright and reclined positions.

In use, back portion 38 of structural shell 14 moves with control arm or bracket 30 between an upright position and a reclined or tilted position (FIGS. 3 and 4). As discussed above, seat portion 26 has a generally concave surface forming a shallow bowl 62 to receive and support the buttocks of a user. Because of this geometry, the linear distance along support shell 14, from back portion 38 through seat portion 26, is significantly longer through the center of bowl 62 than along the peripheral edges of structural shell 14, through hinges 74, for example. As back portion 38 reclines with lever or arm 30, compression forces develop in a structural shell 14 as indicated by arrows "F" in FIG. 4. As chair 10 reclines, compression forces develop, elongated slots 72 deform and narrow, and flexible compression zone 40 compresses in response to the compression forces. Conversely, as chair 10 moves from the reclined position to the upright position, the compression forces diminish, elongated slots 72 resume their undeformed configuration, and flexible compression zone 40 expands to resume its uncompressed configuration. The front of seat portion 26 is fixed to the base pan 24. The front, therefore, does not move during reclining of the chair back. There is zero rise of the chair front. This reduces the thigh compression experienced in prior chairs.

In view of the foregoing description, those of ordinary skill in the art may envision modifications which would not depart from the inventive concepts disclosed herein. Therefore, the above description should be considered that of the preferred embodiment only and that the embodiment shown in the drawings and described above is merely for illustrative purposes. The true spirit and scope of the present invention may be determined by reference to the appended claims.

The embodiments of the invention in which an exclusive property or privilege is claimed are defined as follows:

1. A chair comprising:

a base;

a lever pivotally connected with said base and adapted to rotate between an upright position and a reclined position, said lever having a terminal end away from said base;

a control operatively connected with said lever and adapted to bias said lever toward said upright position;

a back support shell connected with said lever, said back support shell being adapted to support at least a portion of the back of a user, a portion of said back support shell extending in a direction toward said base from said terminal end of said lever; and a seat support shell having a front portion, having an opposing back portion, and being adapted to support at least a portion of the buttocks of a user; said front portion being fixed to said base; said back portion extending generally toward said back support shell from said front portion, being free of said base to flex relative to said front portion, and being connected with said back support shell so said back portion flexes and deflects relative to said front portion when said back support shell rotates with said lever between said upright position and said reclined position.

2. The chair as defined in claim 1 wherein said front portion of said seat support shell includes at least one of a tab which overlaps a portion of said base and a slot adapted to receive a portion of said base to fasten said front portion to said base in fixed relation.

3. The chair as defined in claim 2 wherein said front portion of said seat support shell is fastened to said base in fixed relation by at least one fastener, said at least one fastener extending at least partially into each of said base and said front portion.

4. The chair as defined in claim 2 wherein said chair further includes at least one hinge member interconnecting said back support shell and said back portion of said seat support shell.

5. The chair as defined in claim 4 wherein said back support shell, said seat support shell, and said at least one hinge member are formed in one piece as a unitary shell.

6. The chair as defined in claim 5 wherein said unitary shell has a first side and an opposing second side, a first of said at least one hinge member is located near said first side, and a second of said at least one hinge member is located near said second side.

7. The chair as defined in claim 6 wherein said unitary shell further includes a transition zone extending between said back support shell and said back portion of said seat support shell.

8. The chair as defined in claim 7 wherein said unitary shell is formed of a resilient resin material.

9. The chair as defined in claim 1 wherein said chair further includes at least one hinge member interconnecting said back support shell and said back portion of said seat support shell.

10. The chair as defined in claim 9 wherein said back support shell, said seat support shell, and said at least one hinge member are formed in one piece as a unitary shell.

11. The chair as defined in claim 10 wherein said unitary shell has a first side and an opposing second side, a first of said at least one hinge member is located near said first side, and a second of said at least one hinge member is located near said second side.

12. The chair as defined in claim 11 wherein said unitary shell further includes a transition zone extending between said back support shell and said back portion of said seat support shell.

13. The chair as defined in claim 12 wherein said unitary shell is formed of a resilient resin material.

14. A chair comprising:

a base;

a lever pivotally connected with said base and adapted to rotate between an upright position and a reclined position, said lever having a terminal end away from said base;

a control operatively connected with said lever and adapted to bias said lever toward said upright position;

a back support adapted to support at least a portion of the back of a user, a portion of said back support extending generally toward said base from said terminal end of said lever;

means for connecting said back support with said lever;

a seat support having a front portion and an opposing back portion, and being adapted to support at least a portion of the buttocks of a user, said back portion extending generally toward said back support from said front portion;

means for fastening said front portion of said seat support to said base to preclude rotation and translation of said front portion relative to said base and whereby said back portion of said seat support is free of said base to flex relative to said front portion; and means for interconnecting said back portion of said seat support with said back support so said back portion flexes and deflects relative to said front portion of said seat support when said back support rotates with said lever between said upright position and said reclined position.

15. The chair as defined in claim 14 wherein said front portion of said seat support shell includes at least one of a tab which overlaps a portion of said base and a slot adapted to receive a portion of said base to fasten said front portion to said base in fixed relation.

16. The chair as defined in claim 15 wherein said front portion of said seat support shell is fastened to said base in fixed relation by at least one fastener, said at least one fastener extending at least partially into each of said base and said front portion.

17. The chair as defined in claim 16 wherein said chair further includes at least one hinge member interconnecting said back support shell and said back portion of said seat support shell.

18. The chair as defined in claim 17 wherein said back support shell, said seat support shell, and said at least one hinge member are formed in one piece as a unitary shell.

19. The chair as defined in claim 18 wherein said unitary shell has a first side and an opposing second side, a first of said at least one hinge member is located near said first side, and a second of said at least one hinge member is located near said second side.

20. The chair as defined in claim 19 wherein said unitary shell further includes a transition zone extending between said back support shell and said back portion of said seat support shell.

21. The chair as defined in claim 20 wherein said unitary shell is formed of a resilient resin material.

22. The chair as defined in claim 14 wherein said chair further includes at least one hinge member interconnecting said back support shell and said back portion of said seat support shell.

23. The chair as defined in claim 22 wherein said back support shell, said seat support shell, and said at least one hinge member are formed in one piece as a unitary shell.

24. The chair as defined in claim 23 wherein said unitary shell has a first side and an opposing second side, a first of said at least one hinge member is located near said first side, and a second of said at least one hinge member is located near said second side.

25. The chair as defined in claim 24 wherein said unitary shell further includes a transition zone extending between said back support shell and said back portion of said seat support shell.

26. The chair as defined in claim 25 wherein said unitary shell is formed of a resilient resin material.

27. A chair comprising:

a base;

a lever pivotally connected with said base and adapted to rotate between an upright position and a reclined position, said lever having a terminal end away from said base;

a control operatively connected with said lever and adapted to bias said lever toward said upright position; and a one piece structural shell having a back support connected with said lever, said back support being adapted to support at least a portion of the back of a user, a portion of said back support extending in a direction toward said base from said terminal end of said lever; having a seat support with a front portion and an opposing back portion, said seat support being adapted to support at least a portion of the buttocks of a user, said front portion being fixed to said base to preclude rotation and translation of said front portion relative to said base, said back portion extending generally toward said back support from said front portion and being free of said base to flex relative to said front portion; and having a flexible zone interconnecting said back portion of said seat support with said back support so said back portion flexes and deflects relative to said front portion when said back support rotates with said lever between said upright position and said reclined position.

28. The chair as defined in claim 27 wherein said front portion of said seat support of said one piece structural shell includes at least one of a tab which overlaps a portion of said base and a slot adapted to receive a portion of said base to fasten said front portion to said base in fixed relation.

29. The chair as defined in claim 28 wherein said front portion of said seat support of said one piece structural shell is fastened to said base in fixed relation by at least one fastener, said at least one fastener extending at least partially into each of said base and said front portion.

30. The chair as defined in claim 29 wherein said chair further includes at least one hinge member interconnecting said back support of said one piece structural shell and said back portion of said seat support of said one piece structural shell.

31. The chair as defined in claim 30 wherein said unitary shell has a first side and an opposing second side, a first of said at least one hinge member is located near said first side, and a second of said at least one hinge member is located near said second side.

32. The chair as defined in claim 31 wherein said unitary shell is formed of a resilient resin material.

33. The chair as defined in claim 27 wherein said chair further includes at least one hinge member interconnecting said back support of said one piece structural shell and said back portion of said seat support of said one piece structural shell.

34. The chair as defined in claim 33 wherein said unitary shell has a first side and an opposing second side, a first of said at least one hinge member is located near said first side, and a second of said at least one hinge member is located near said second side.

35. The chair as defined in claim 34 wherein said unitary shell is formed of a resilient resin material.

* * * * *